US010141697B2

(12) United States Patent
Wang et al.

(10) Patent No.: US 10,141,697 B2
(45) Date of Patent: Nov. 27, 2018

(54) ELECTRICAL CONNECTOR

(71) Applicant: LOTES CO., LTD, Keelung (TW)

(72) Inventors: Zhi Wang, Keelung (TW); Wen Jie Tong, Keelung (TW)

(73) Assignee: LOTES CO., LTD, Keelung (TW)

( * ) Notice: Subject to any disclaimer, the term of this patent is extended or adjusted under 35 U.S.C. 154(b) by 0 days.

(21) Appl. No.: 15/867,990

(22) Filed: Jan. 11, 2018

(65) Prior Publication Data

US 2018/0212376 A1 Jul. 26, 2018

(30) Foreign Application Priority Data

Jan. 25, 2017 (CN) ..... 2017 2 0096650 U
Jun. 22, 2017 (CN) ..... 2017 2 0732220 U

(51) Int. Cl.

| | |
|---|---|
| ***H01R 12/71*** | (2011.01) |
| ***H01R 13/64*** | (2006.01) |
| ***H01R 24/60*** | (2011.01) |
| ***H01R 107/00*** | (2006.01) |
| ***H01R 13/502*** | (2006.01) |
| ***H01R 13/631*** | (2006.01) |
| ***H01R 13/6581*** | (2011.01) |
| ***H01R 13/6594*** | (2011.01) |

(52) U.S. Cl.

CPC ..... *H01R 24/60* (2013.01); *H01R 13/502* (2013.01); *H01R 13/631* (2013.01); *H01R 13/6581* (2013.01); *H01R 13/6594* (2013.01); *H01R 12/716* (2013.01); *H01R 13/64* (2013.01); *H01R 2107/00* (2013.01)

(58) Field of Classification Search

CPC ..... H01R 13/658–13/6597
USPC ..... 439/607.01–607.58
See application file for complete search history.

(56) References Cited

U.S. PATENT DOCUMENTS 6,010,367 A * 1/2000 Wu ..... H01R 13/514 439/620.23
6,267,624 B1 * 7/2001 Wu ..... H01R 13/658 439/607.35

(Continued)

FOREIGN PATENT DOCUMENTS

| | | |
|---|---|---|
| CN | 201000934 Y | 1/2008 |
| CN | 201667447 U | 12/2010 |
| CN | 205693075 U | 11/2016 |

*Primary Examiner* — Gary F Paumen
(74) *Attorney, Agent, or Firm* — Locke Lord LLP; Tim Tingkang Xia, Esq.

(57) ABSTRACT

An electrical connector configured to be electrically connected with a mating connector, including an insulating body, having a mating cavity enclosed by a top plate, a bottom plate and two side plates, allowing an insertion portion of the mating connector to be inserted backward therein. Multiple accommodating grooves are formed on the top plate and the bottom plate. A front end of each side plate is concavely provided with a groove communicating with the mating cavity. Multiple terminals are correspondingly accommodated in the accommodating grooves. A shielding shell is fixed to the insulating body. A mating port is enclosed by front ends of a top wall and two side walls of the shielding shell, and is larger than the mating cavity. Two protective members are correspondingly accommodated in the grooves. A front end of each protective member is spaced from the front end of the corresponding side wall.

20 Claims, 16 Drawing Sheets

(56) References Cited

U.S. PATENT DOCUMENTS

| | | | | |
|---|---|---|---|---|
| 7,226,314 | B2 | 6/2007 | Lang et al. | |
| 2007/0173118 | A1* | 7/2007 | Chen | H01R 23/6873 439/607.01 |
| 2010/0035465 | A1* | 2/2010 | Wang | H01R 13/502 439/541.5 |
| 2017/0373441 | A1* | 12/2017 | Zhao | H01R 12/58 |
| 2018/0115098 | A1* | 4/2018 | Little | H01R 13/6582 |

* cited by examiner

100

100

100

ELECTRICAL CONNECTOR

CROSS-REFERENCE TO RELATED PATENT APPLICATION

This application claims priority to and the benefit of, pursuant to 35 U.S.C. § 119(a), Patent Application Serial No. CN201720096650.X filed in P.R. China on Jan. 25, 2017, and Patent Application Serial No. CN201720732220.2 filed in P.R. China on Jun. 22, 2017. The entire contents of the above-identified applications are incorporated herein in their entireties by reference.

Some references, which may include patents, patent applications and various publications, are cited and discussed in the description of this disclosure. The citation and/or discussion of such references is provided merely to clarify the description of the present disclosure and is not an admission that any such reference is "prior art" to the disclosure described herein. All references cited and discussed in this specification are incorporated herein by reference in their entireties and to the same extent as if each reference was individually incorporated by reference.

FIELD

The present invention relates to an electrical connector, in particular to an electrical connector capable of preventing a mating connector from scratching an insulating body.

BACKGROUND

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

During the mating of two connectors, a lot of time is spent in alignment since there is often no proper guiding devices between a receptacle and a plug. Deviation or malposition of the plug by a small angle can make mating of the plug and the receptacle unsmooth, and even cause damage to a connector structure.

The U.S. Pat. No. 7,226,314 discloses a receptacle connector, which has an insulating body and a guiding shell. The insulating body includes a mating groove which is formed at the front end of the insulating body, and multiple terminal slots are formed on two opposite sides of the mating groove to accommodate multiple terminals. The guiding shell includes an accommodating space formed by an upper board and two partitioning boards. The upper board bends towards the accommodating space to form two elastic arms, and the guiding shell is located at a front end of an opening of the mating groove of the insulating body, so that the insulating body and the guiding shell can be assembled to form the receptacle connector.

In the patent, the guiding shell is fixed to the front end of the opening of the mating groove of the insulating body. When the receptacle connector is mated with a plug connector, the plug connector can effectively provide quick positioning for the vertical position under the guiding of the elastic arms, allowing a tongue of the plug connector to be accurately inserted into the mating groove, and accommodating the plug connector in the accommodating space of the guiding shell, thus reducing the time wasted by alignment failure during connector mating. However, in the patent, although vertical alignment can be accurately provided during mating of the tongue of the plug connector and the receptacle connector, a solution for horizontal alignment is not provided. During the connector mating, the tongue is prone to left-right deviation due to the incorrect horizontal alignment, and the insulating body of the receptacle connector can be scratched easily due to incorrect alignment of the tongue, thereby causing damage to the insulating body, and accordingly affecting the service life of the receptacle connector.

Therefore, a heretofore unaddressed need to design a new electrical connector exists in the art to address the aforementioned deficiencies and inadequacies.

SUMMARY

An objective of the present invention is to provide an electrical connector capable of preventing a mating connector from scratching an insulating body thereof.

To achieve the foregoing objective, one aspect of the invention provides an electrical connector configured to be electrically connected with a mating connector, including: an insulating body, comprising a mating cavity enclosed by a top plate, a bottom plate and two side plates, the mating cavity allows an insertion portion of the mating connector to be inserted backward therein, wherein the top plate and the bottom plate are provided with a plurality of accommodating grooves, a front end of each of the two side plates is backward concavely provided with a groove, and the grooves communicate with the mating cavity; a plurality of terminals, correspondingly accommodated in the accommodating grooves; a shielding shell, fixed to the insulating body and provided with a top wall and two side walls located on two opposite sides of the top wall, wherein a mating port is enclosed by front ends of the top wall and the two side walls, the mating port is larger than the mating cavity, the top wall shields the top plate and extends forward beyond the top plate, and each of the side walls shields a corresponding one of the side plates and extends forward beyond the corresponding one of the side plates; and two protective members, respectively and correspondingly accommodated in the grooves, wherein a front end of each of the protective members is spaced from the front end of a corresponding one of the side walls in a front-rear direction.

In certain embodiments, an inner surface of each of the side walls protrudes inward to form a corresponding one of the protective members.

In certain embodiments, each of the side walls is concavely provided with two notches respectively at a top end and a bottom end of the corresponding one of the protective members, the notches extend through toward rear ends of the side walls, and each of the protective members is located between the mating cavity and the corresponding one of the side plates.

In certain embodiments, two limiting portions are provided at a rear end of each of the side walls and located above and below the corresponding one of the protective members respectively, and the insulating body is provided with two limiting slots to stop the two limiting portions respectively.

In certain embodiments, each of the side plates is provided with a barrier portion between the two limiting slots, and each of the side walls is stopped backward at a front end of the corresponding barrier portion.

In certain embodiments, each of the side plates is provided with a barrier portion between the two limiting slots, and each of the protective members is located between the mating cavity and the corresponding barrier portion.

In certain embodiments, each of the side walls is punched inwards to form the corresponding one of the protective members, and each edge of the protective members is connected with the side walls.

In certain embodiments, a top end of each of the protective members is higher than the mating cavity, and a bottom end of each of the protective members is lower than the mating cavity.

In certain embodiments, a guide chamfer is provided at a front end of each of the protective members, and the guide chamfer is located in front of a corresponding one of the side plates and shields a front end of the corresponding one of the side plates.

In certain embodiments, the insulating body is protrudingly provided with two mounting portions installed in two mounting holes of a circuit board, one of the mounting portions is rhombic and the other mounting portion is cylindrical, a concave portion is formed at each of side edges of the insulating body and extends to a corresponding one of the mounting portions, and an edge of each of the mounting portions is spaced from a corresponding one of the side edges of the insulating body.

In certain embodiments, the shielding shell is further provided with a bottom wall connected with the two side walls, two protruding bars are protrudingly provided upward on the bottom wall, two recesses are correspondingly formed on the bottom plate, and the recesses run through a front end of the bottom plate and accommodate the protruding bars.

In certain embodiments, the top wall is further provided with two side portions and a protrusion portion located between the two side portions, the protrusion portion is provided with at least one buckling hole configured for latching the mating connector, and a projection of the protrusion portion on the bottom wall is located between the two protruding bars.

In certain embodiments, a portion of each of the protruding bars protrudes forward out of the front end of the bottom plate.

In certain embodiments, each of the side plates is provided with a first surface and a second surface formed by extending backward from the first surface, each of the protective members is stopped backward to the corresponding first surface, and each of the protective members is parallel to the second surface and do not extend laterally and inwardly beyond the second surface.

In certain embodiments, each of the grooves runs through the corresponding side plate from inside to outside, such that a front end of the top plate protrudes forward out of the front end of each of the side plates.

In certain embodiments, a protruding block is protrudingly formed outward on an outer surface of each of the side plates, and the protruding block extends from one side of the corresponding groove.

In certain embodiments, a protruding portion is protrudingly formed outward on an outer surface of each of the side walls, and the protruding portion covers the corresponding protruding block.

In certain embodiments, the protective members and the shielding shell are arranged separately, each of the protective members protrudes forward out of a front end of a corresponding one of the side plates, and a front end of the protruding portion is located in front of the corresponding one of the protective members and shields a front end of the corresponding one of the protective members.

In certain embodiments, the protective members and the shielding shell are arranged separately, and each of the protective members is protrudingly provided with a plurality of fastening portions to match with the groove, so as to fix the protective members in the corresponding grooves.

In certain embodiments, an inner surface of each of the protective members is provided with a rib extending in a vertical direction, and the rib protrudingly extends into the mating cavity.

Compared with the related art, the electrical connector according to certain embodiments of the invention has the advantages that: each groove is concavely formed backward at the front end of the corresponding side plate of the insulating body and communicates with the mating cavity, and the two protective members are correspondingly accommodated in the grooves, thus allowing the protective members to shield the side plates. When the insertion portion of the mating connector is inserted into the mating cavity, the insertion portion directly contacts with the protective members, thereby effectively reducing scratching and damage of the side plates caused by incorrect alignment of the insertion portion, and prolonging the service life of the electrical connector, so that the electrical connector can better meet the requirements of users.

These and other aspects of the present invention will become apparent from the following description of the preferred embodiment taken in conjunction with the following drawings, although variations and modifications therein may be effected without departing from the spirit and scope of the novel concepts of the disclosure.

BRIEF DESCRIPTION OF THE DRAWINGS

The accompanying drawings illustrate one or more embodiments of the disclosure and together with the written description, serve to explain the principles of the disclosure. Wherever possible, the same reference numbers are used throughout the drawings to refer to the same or like elements of an embodiment.

DETAILED DESCRIPTION

Figure 1:
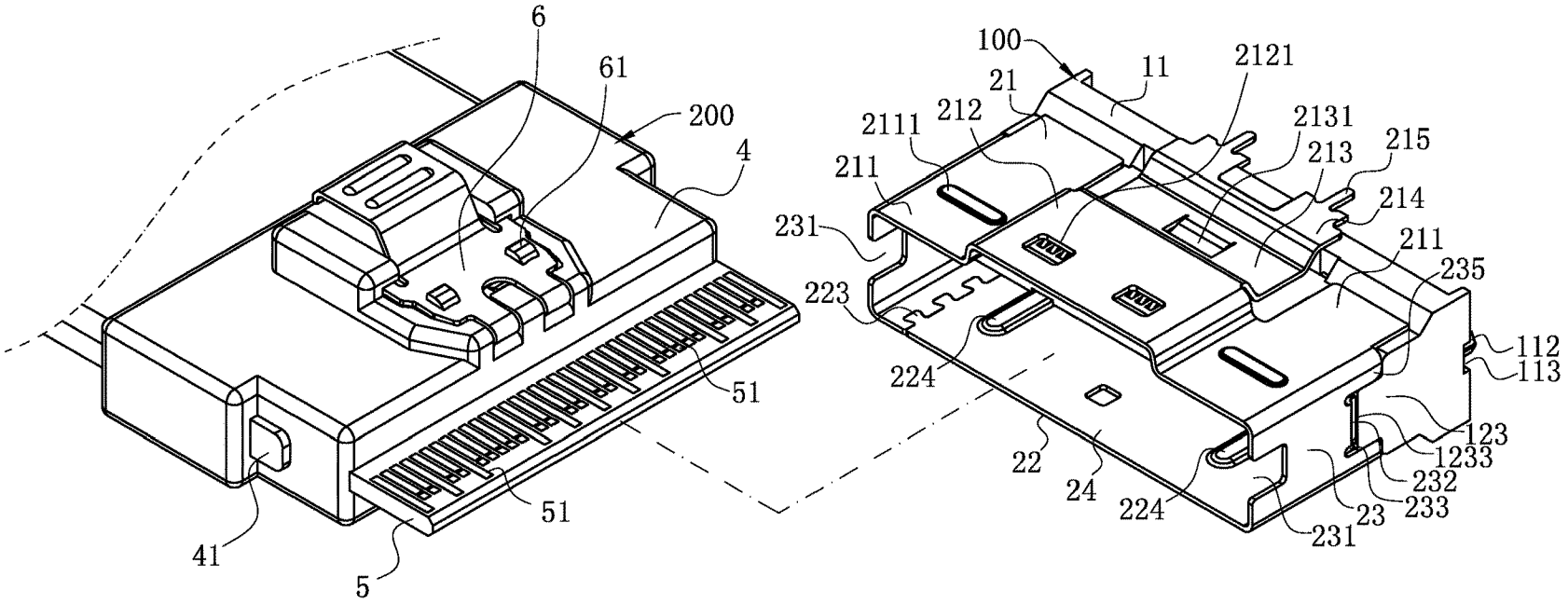
FIG. 1 is a three-dimensional schematic view of an electrical connector according to a first embodiment of the present invention before mating with a mating connector.

The present invention is more particularly described in the following examples that are intended as illustrative only since numerous modifications and variations therein will be apparent to those skilled in the art. Various embodiments of the invention are now described in detail. Referring to the drawings, like numbers indicate like components throughout the views. As used in the description herein and throughout the claims that follow, the meaning of "a", "an", and "the" includes plural reference unless the context clearly dictates otherwise. Also, as used in the description herein and throughout the claims that follow, the meaning of "in" includes "in" and "on" unless the context clearly dictates otherwise. Moreover, titles or subtitles may be used in the specification for the convenience of a reader, which shall have no influence on the scope of the present invention.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower", can therefore, encompasses both an orientation of "lower" and "upper," depending of the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

As used herein, "around", "about" or "approximately" shall generally mean within 20 percent, preferably within 10 percent, and more preferably within 5 percent of a given value or range. Numerical quantities given herein are approximate, meaning that the term "around", "about" or "approximately" can be inferred if not expressly stated.

As used herein, the terms "comprising", "including", "carrying", "having", "containing", "involving", and the like are to be understood to be open-ended, i.e., to mean including but not limited to.

The description will be made as to the embodiments of the present invention in conjunction with the accompanying drawings in FIGS. 1-16. In accordance with the purposes of this invention, as embodied and broadly described herein, this invention, in one aspect, relates to an electrical connector.

Figure 2:
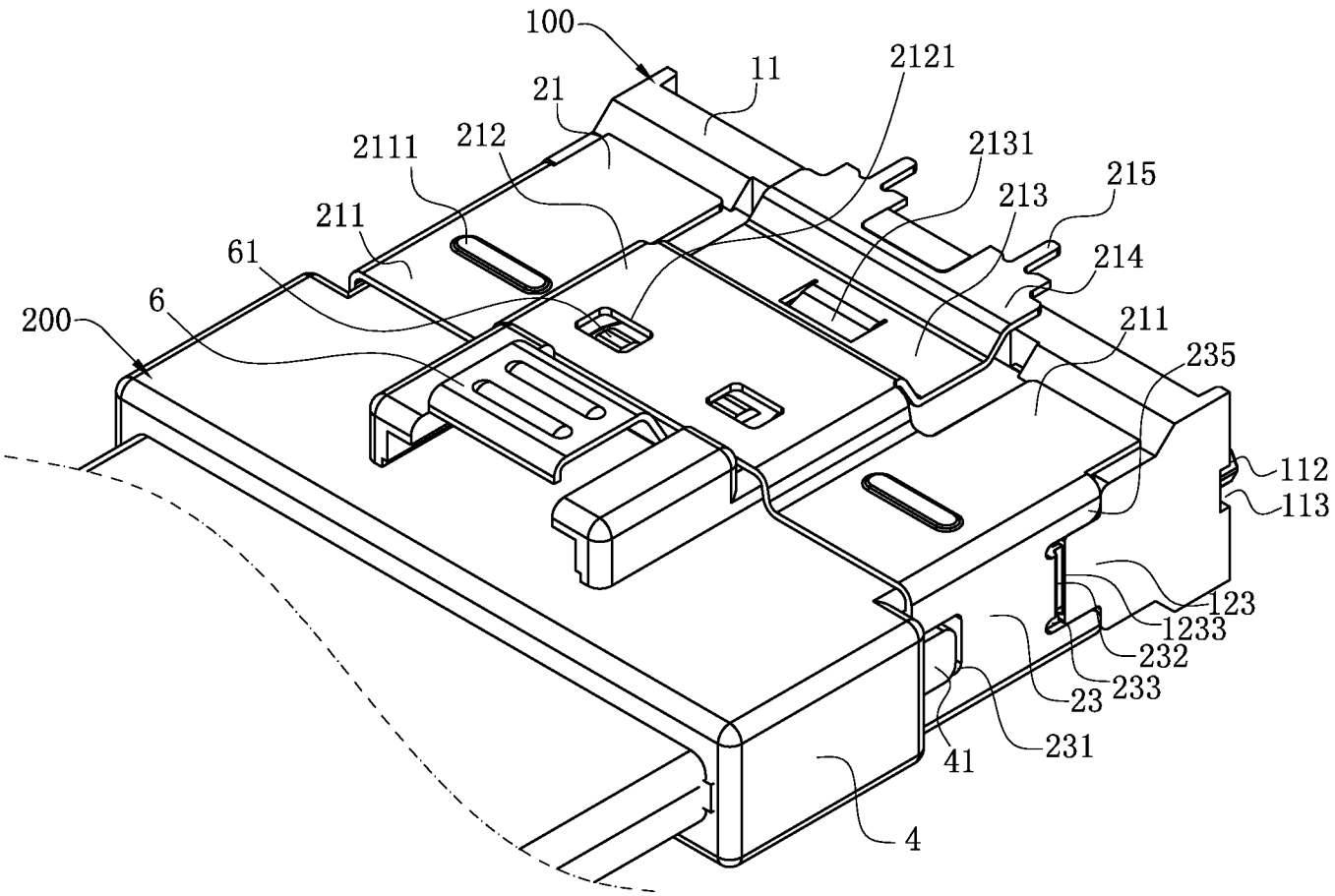
FIG. 2 is a schematic view of the electrical connector in FIG. 1 after mating with the mating connector.
Figure 3:
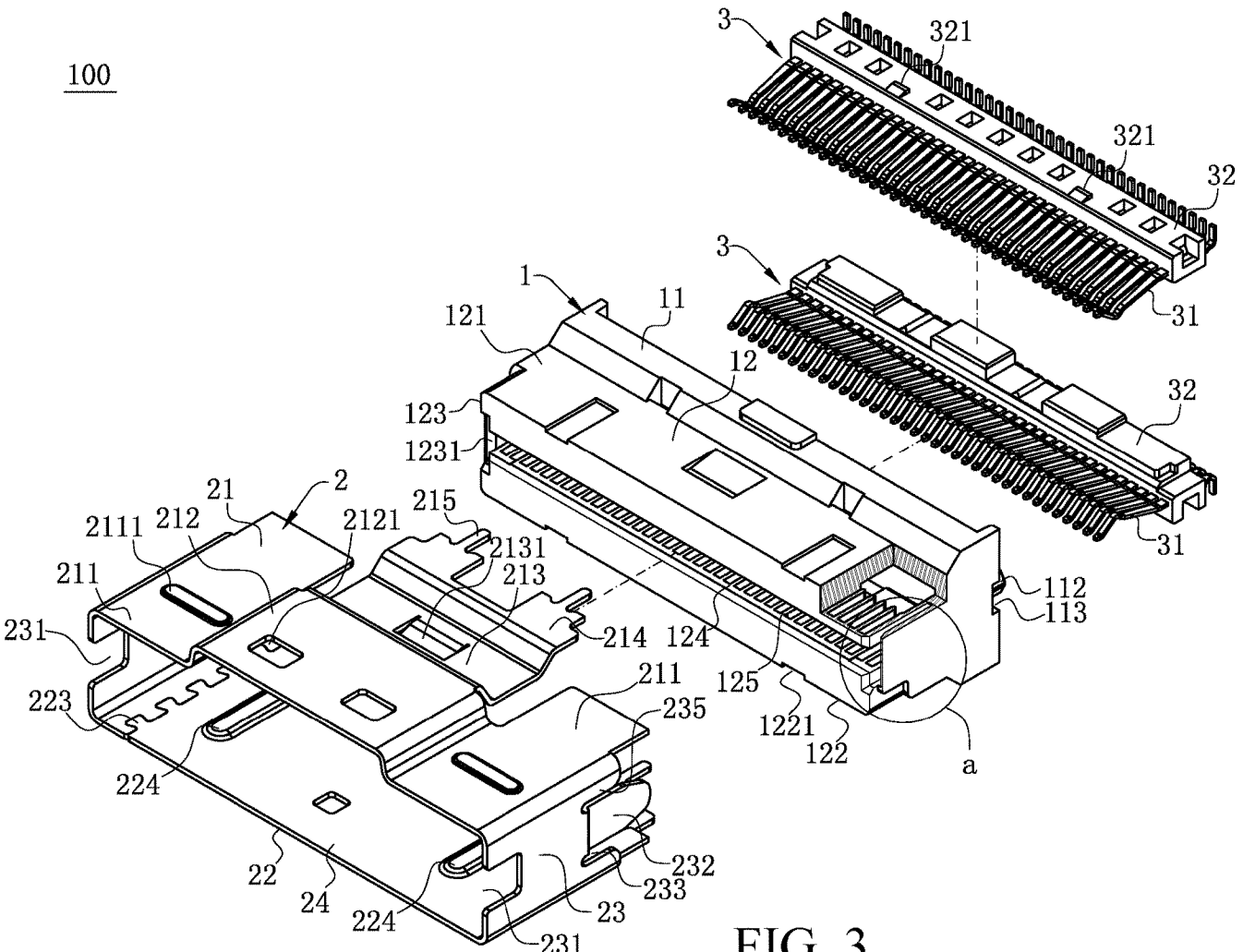
FIG. 3 is a three-dimensional exploded view of the electrical connector in FIG. 1.

FIG. 1 to FIG. 9 show an electrical connector 100 according to a first embodiment of the present invention. As shown in FIG. 1 to FIG. 3, the electrical connector 100 is configured to be in an insertion connection with an insertion portion 5 of a mating connector 200, and includes an insulating body 1, two terminal modules 3 installed in the insulating body 1, and a shielding shell 2 covering the insulating body 1.

Figure 4:
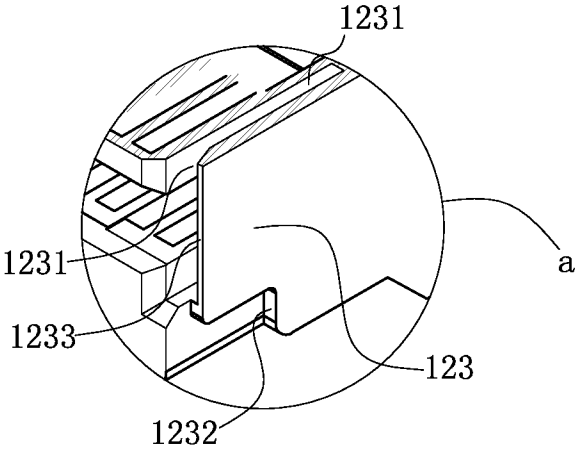
FIG. 4 is an enlarged view of a part a in FIG. 3.
Figure 5:
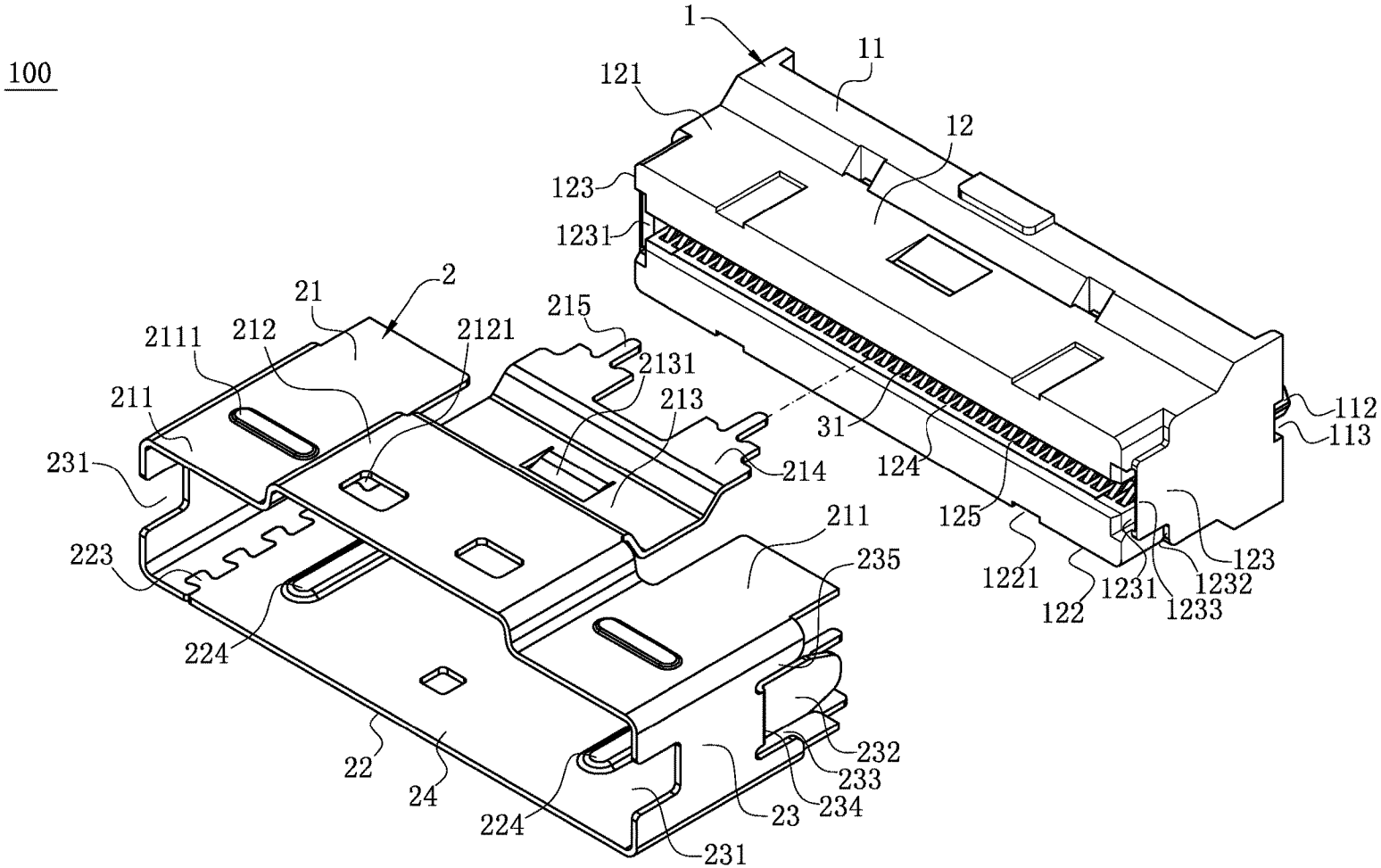
FIG. 5 is a schematic view of a terminal module and an insulating body in FIG. 3 after being assembled.

As shown in FIG. 3 to FIG. 5, the insulating body 1 is in a longitudinal shape. The insulating body 1 is provided with a frame portion 11 and a base 12 extending forward from the frame portion 11. The base 12 is provided with a mating cavity 124 enclosed by a top plate 121, a bottom plate 122 and two side plates 123. The mating cavity 124 runs through the base 12 in a front-rear direction, and allows the insertion portion 5 to be inserted therein. An upper surface of the frame portion 11 is higher than the top plate 121, and a lower surface of the frame portion 11 is lower than the bottom plate 122. Multiple accommodating grooves 125 are formed on the top plate 121 and the bottom plate 122 respectively, and the accommodating grooves 125 are symmetrically arranged in an upper row and a lower row.

A groove 1231 is concavely provided backward at a front end of each side plate 123. The grooves 1231 communicate with the mating cavity 124. Each groove 1231 is provided in a vertically symmetrical way with respect to the mating cavity 124. The highest point of each groove 1231 is higher than the mating cavity 124, and the lowest point of each groove 1231 is lower than the mating cavity 124. An outer side surface of each side plate 123 is flush with a corresponding outer side surface of the frame portion 11.

Figure 8:
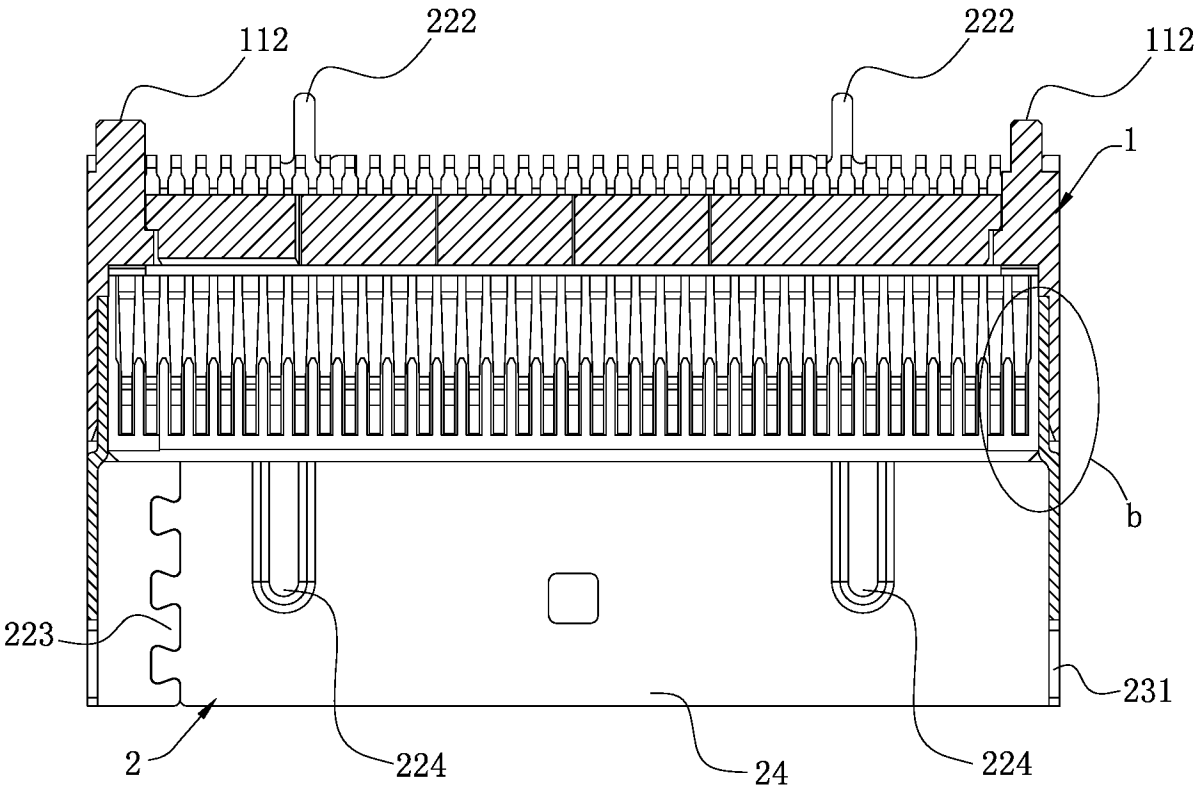
FIG. 8 is a cross-sectional view of FIG. 6.
Figure 9:
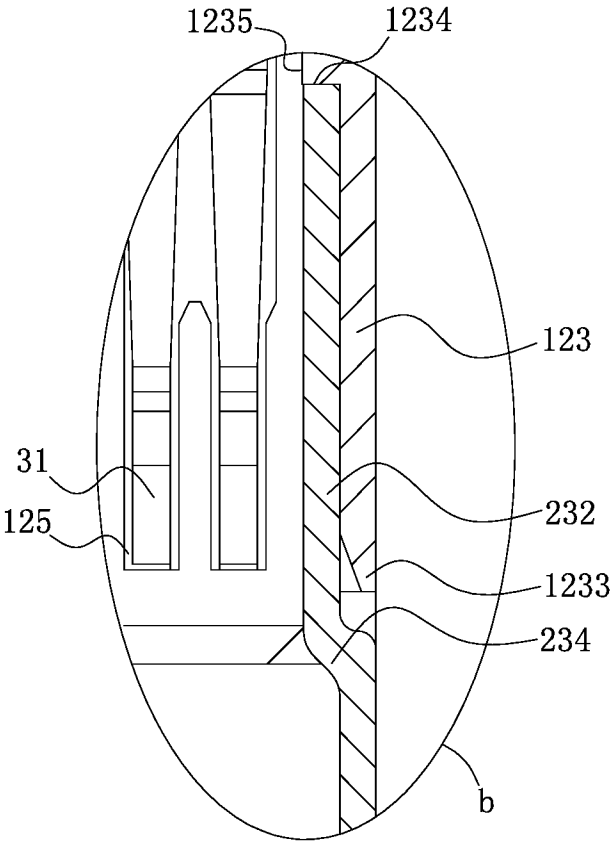
FIG. 9 is an enlarged view of a part b in FIG. 8.
Figure 10:
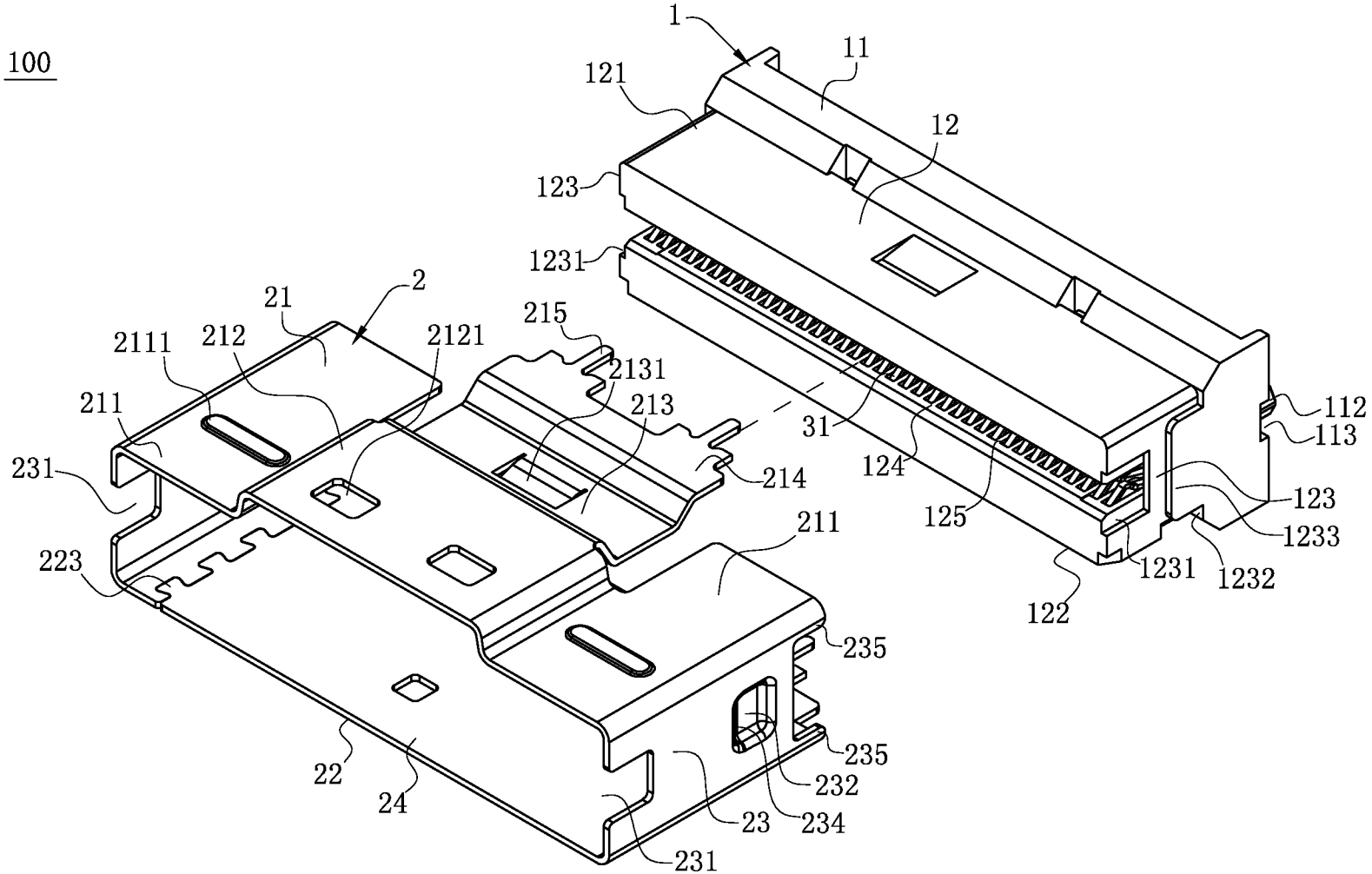
FIG. 10 is a three-dimensional schematic view of the electrical connector according to a second embodiment of the present invention before being assembled.
Figure 11:
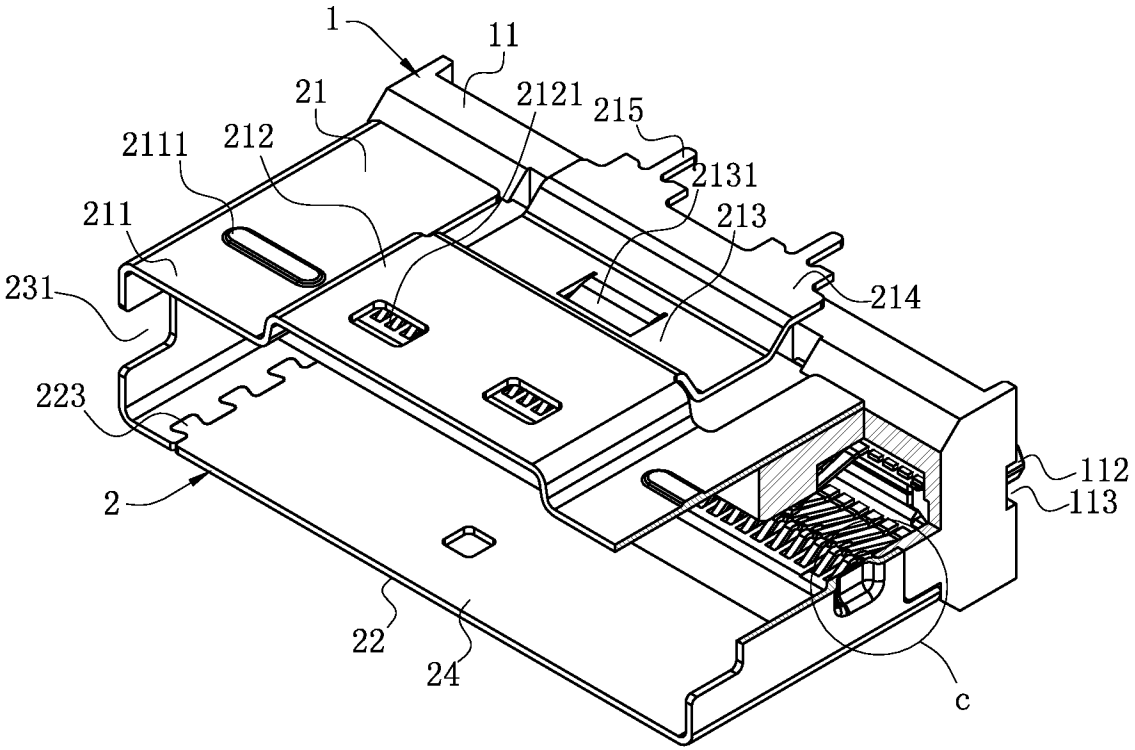
FIG. 11 is a schematic view of the electrical connector in FIG. 10 after being assembled.
Figure 12:
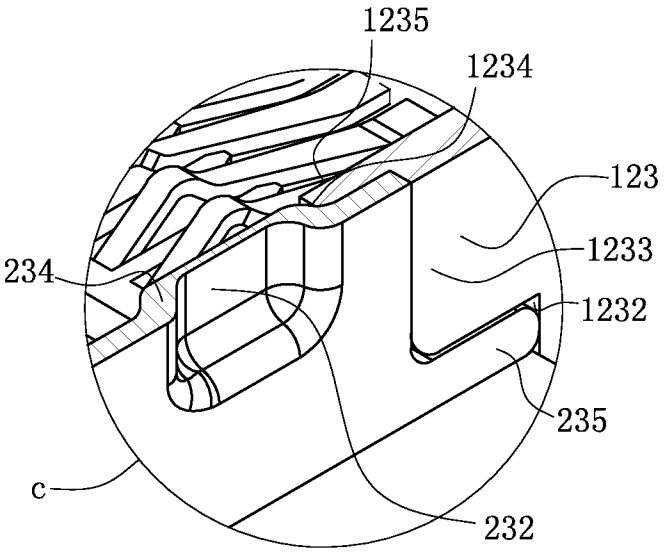
FIG. 12 is an enlarged view of a part c in FIG. 11.
Figure 13:
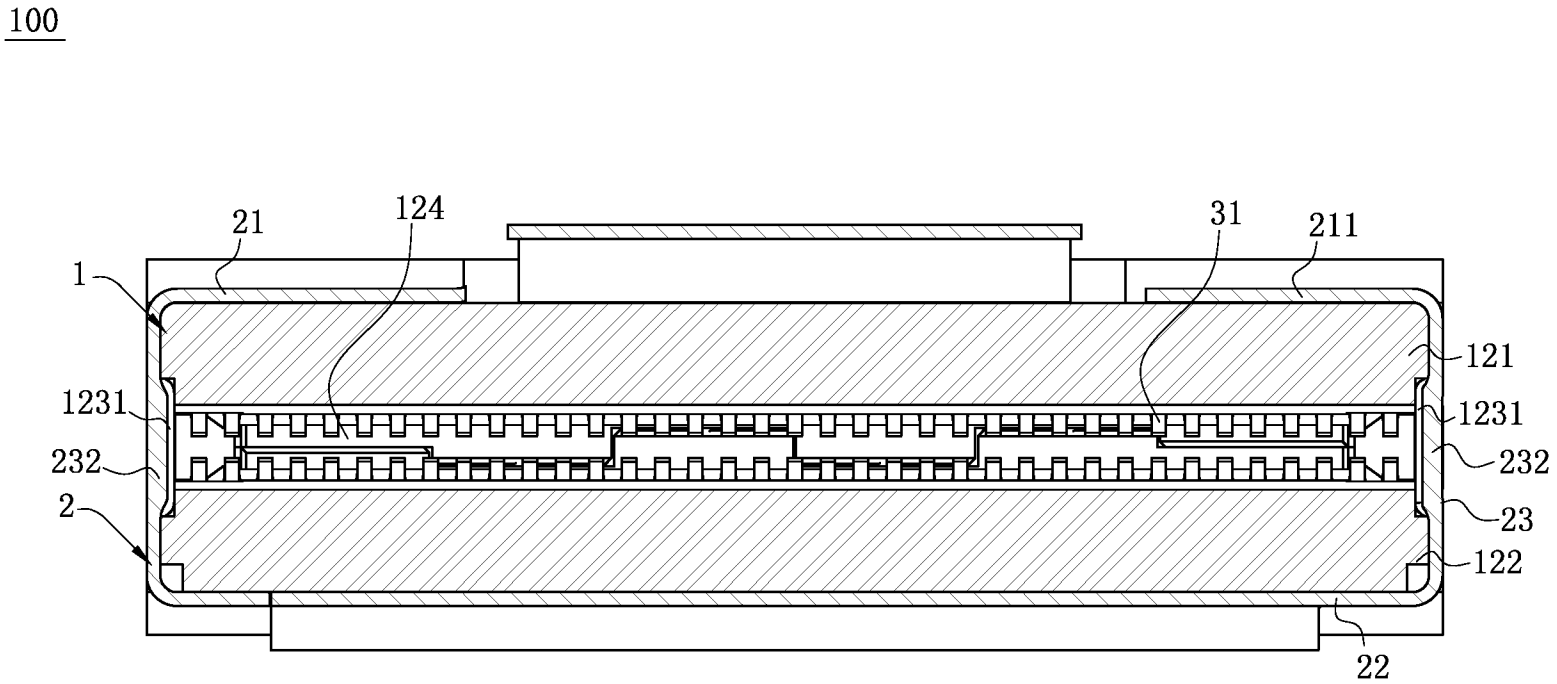
FIG. 13 is a cross-sectional view of FIG. 11.
Figure 14:
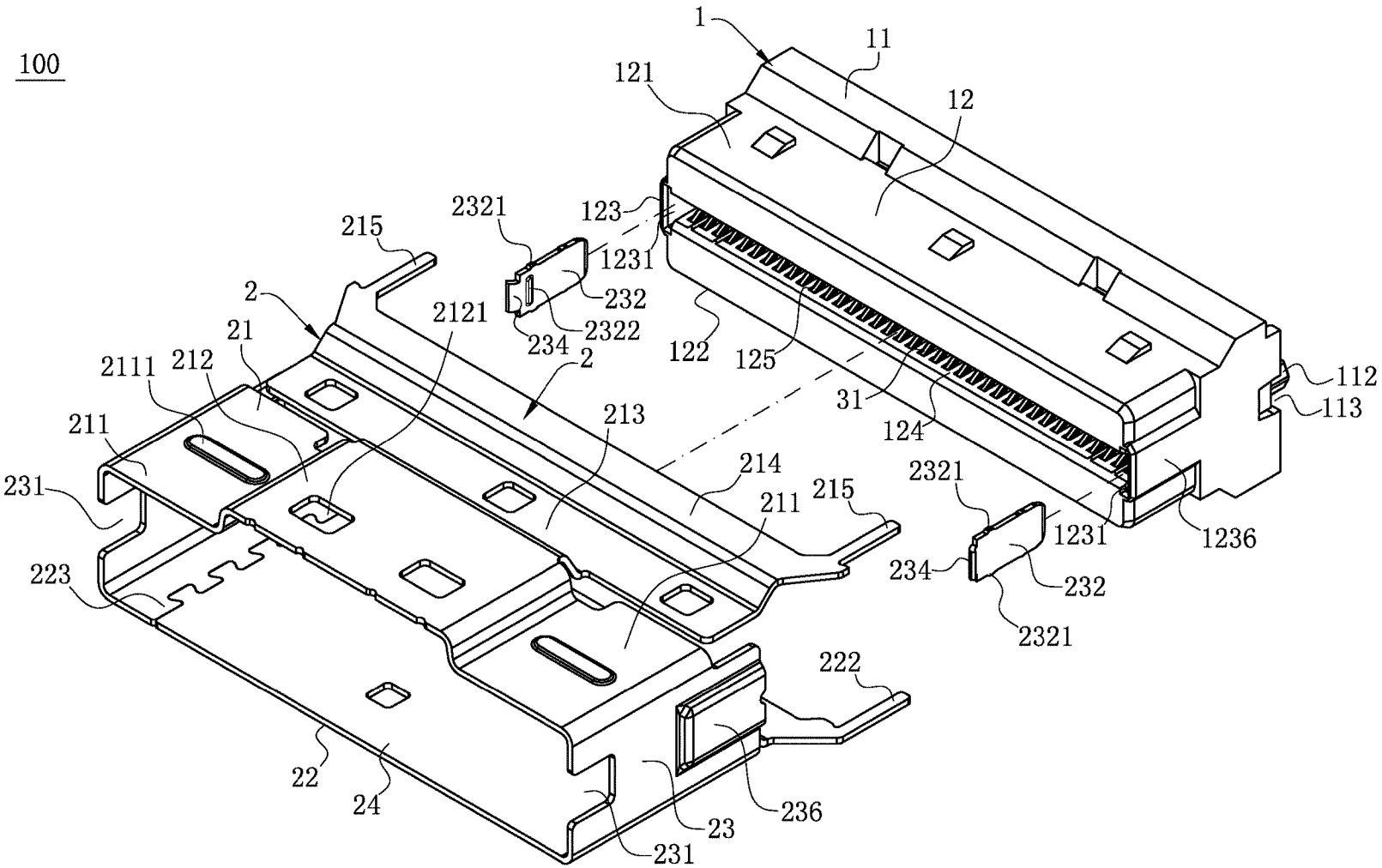
FIG. 14 is a three-dimensional schematic view of the electrical connector according to a third embodiment of the present invention before being assembled.
Figure 15:
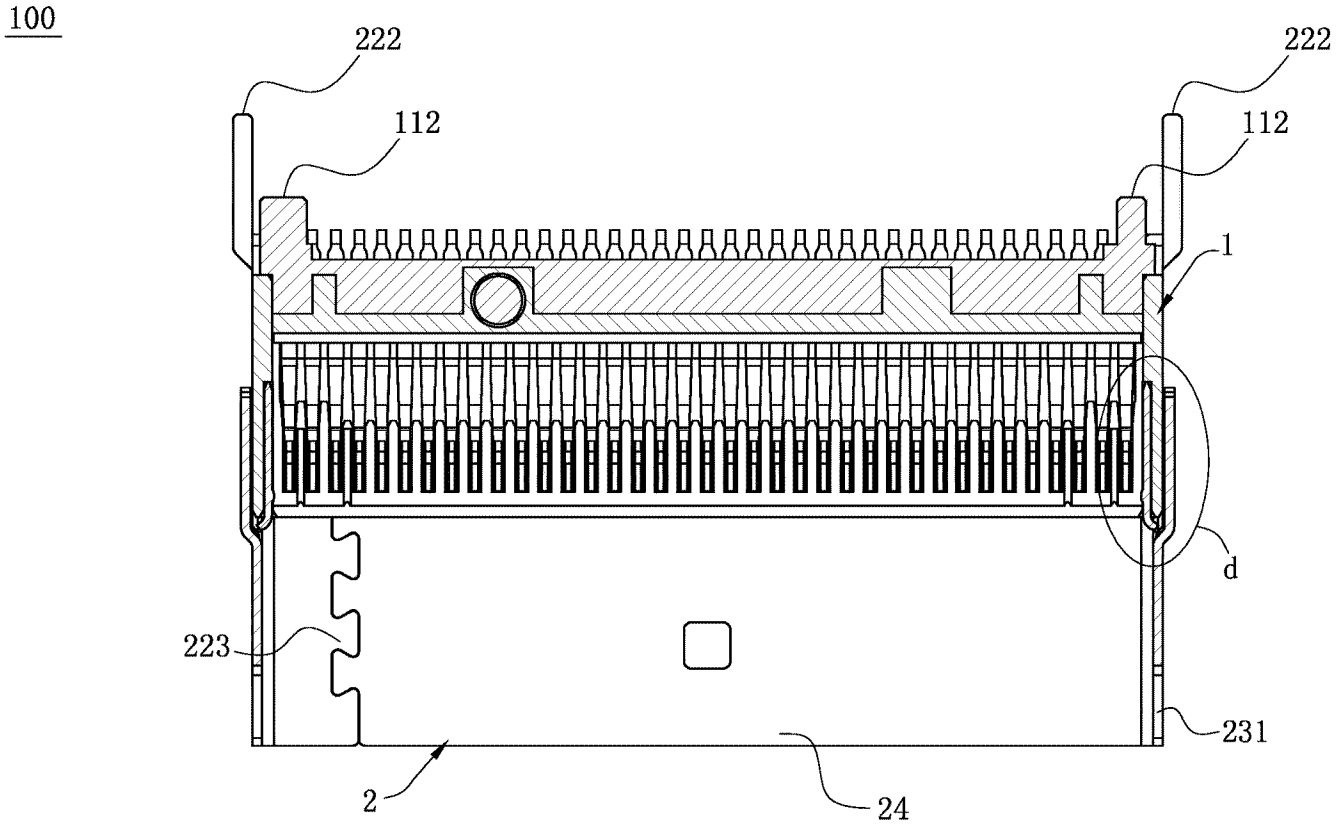
FIG. 15 is a cross-sectional view of the electrical connector in FIG. 14 after being assembled.
Figure 16:
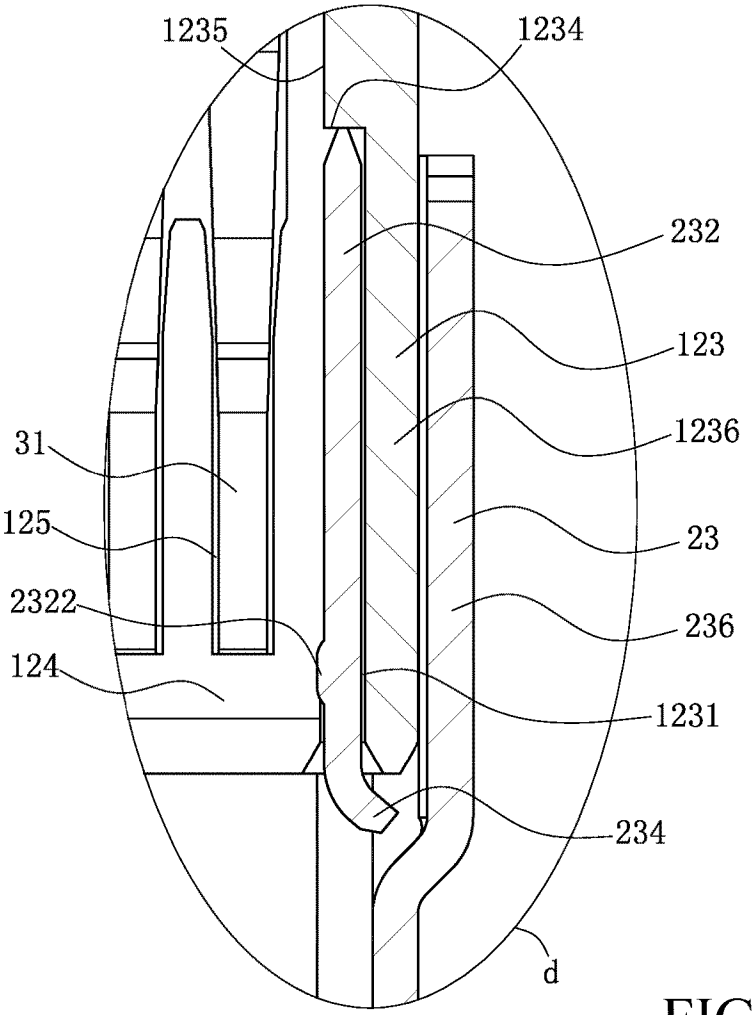
FIG. 16 is an enlarged view of a part d in FIG. 15.

As shown in FIG. 3 to FIG. 5, the shielding shell 2 is provided with a top wall 21 and a bottom wall 22 opposite to each other, and two side walls 23 connected with the top wall 21 and the bottom wall 22. In other embodiments, the top wall 21, the bottom wall 22 and the side walls 23 can be formed separately. The top wall 21 shields the top plate 121 and extends forward beyond the top plate 121. The bottom wall 22 shields the bottom plate 122 and extends forward beyond the bottom plate 122. Each side wall 23 is shielded by a corresponding one of the side plates 123 and extends forward beyond the corresponding one of the side plates 123. The top wall 21 and the bottom wall 22 abut backward against a front end of the frame portion 11. A mating port 24 is formed at a front end of the shielding shell 2 and located in front of the mating cavity 124. A width of the mating port 24 is wider than that of the mating cavity 124, and a length of the mating port 24 is longer than that of the mating cavity 124, so that when the insertion portion 5 is inserted into the mating port 24, there is a gap between the insertion portion 5 and the mating port 24, resulting in oblique insertion of the insertion portion 5 by incorrect alignment. A rectangular opening 231 is formed at the front end of each side wall 23, and a rear end of each side wall 23 bends and extends backwards to form a protective member 232. The protective members 232 are accommodated in the grooves 1231. A top end of each protective member 232 is higher than the mating cavity 124, and a bottom end of each protective member 232 is lower than the mating cavity 124. Each protective member 232 is located between the mating cavity 124 and the corresponding one of the side plate 123. Each side wall 23 is concavely provided with two notches 233 respectively at a top end and a bottom end of the corresponding protective member 232. The notches 233 extend through toward a rear end of the corresponding side wall 23. Two limiting portions 235 are provided at the rear end of each side wall 23 and located above and below the corresponding protective member 232 respectively. Each side plate 123 of the insulating body 1 is provided with two limiting slots 1232 to stop the two limiting portions 235 respectively. An outer surface of each limiting portion 235 is flush with an outer surface of the corresponding side plate 123, and an inner surface of each limiting portion 235 is flush with an outer surface of the corresponding protective member 232. Each side plate 123 is further provided with a barrier portion 1233 located between the two limiting slots 1232, and each protective member 232 is located between the mating cavity 124 and the corresponding barrier portion 1233. As shown in FIG. 8 and FIG. 9, each side plate 123 is provided with a first surface 1234 and a second surface 1235 formed by extending backward from the first surface 1234, and each first surface 1234 is perpendicular to the corresponding second surface 1235. Each protective member 232 is stopped backward to the corresponding first surface 1234, and each protective member 232 is parallel to the corresponding second surface 1235 and does not extend laterally and inwardly beyond the second surface 1235. A guide chamfer 234 is further provided at a front end of each protective member 232. The guide chamfer 234 is located in front of the corresponding side plate 123, and shields the front end of the corresponding side plate 123.

The top wall 21 is provided with two side portions 211 and a protrusion portion 212 located between the two side portions 211. A middle portion 213 is formed to be located on the same plane with the side portions 211 by bending downward and extending backward from the protrusion portion 212. The middle portion 213 abuts against the base 12. A first urging portion 214 is formed by bending upward and extending backward from the middle portion 213. The first urging portion 214 abuts against the frame portion 11. A rear end of the first urging portion 214 continues to extend backward to form a pair of first pins 215. The first pins 215 are punching-soldered to a circuit board (not shown). The protrusion portion 212 is further provided with at least one buckling hole 2121 configured for latching the mating connector 200. In this embodiment, the protrusion portion 212 is provided with two buckling hole 2121. A rear end of the bottom wall 22 bends to form a second urging portion 221. The second urging portion 221 abuts against the frame portion 11. A pair of second pins 222 are formed by extending backward from the second urging portion 221. The second pins 222 are also punching-soldered to the circuit board (not shown). The first pins 215 are located between the second pins 222 in a lateral direction (i.e., a horizontal direction as shown in FIG. 7).

Figure 7:
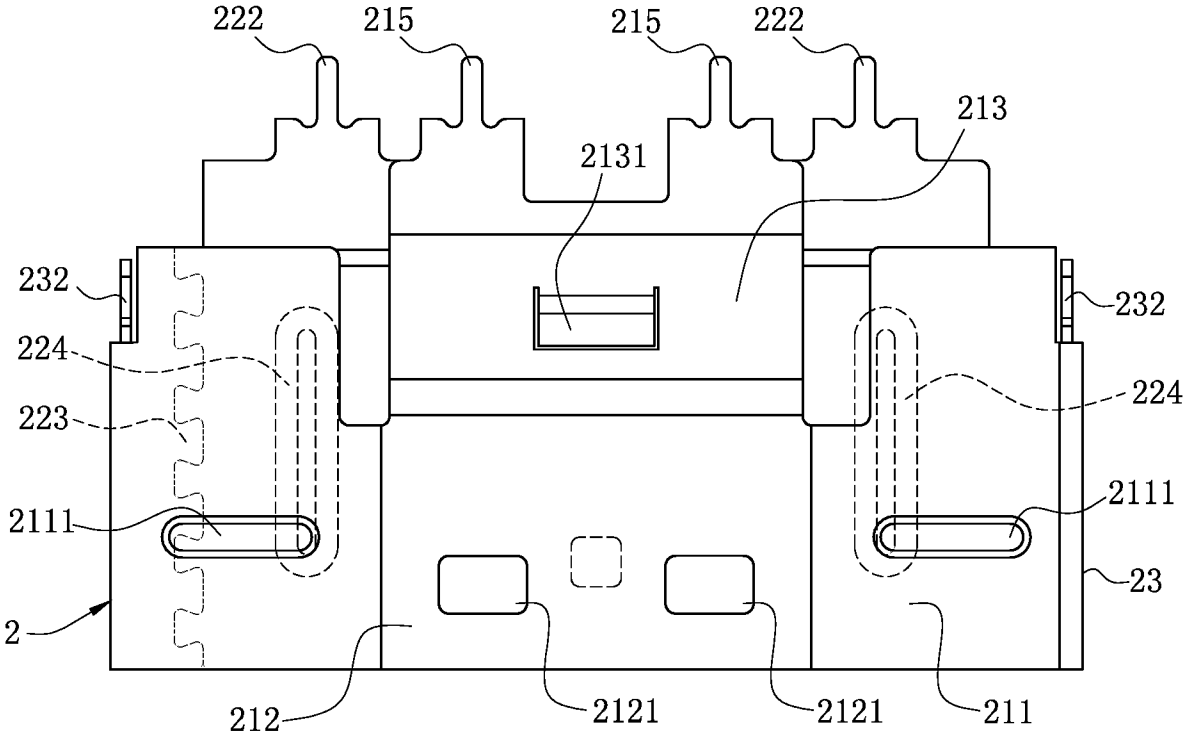
FIG. 7 is a top view of a shielding shell in FIG. 3.

As shown in FIG. 5 and FIG. 7, two reinforcing ribs 2111 are protrudingly provided upward on the two side portions 211, and are located on two opposite sides of the protruding portion 212. The reinforcing ribs 2111 are located in front of the top plate 121. The reinforcing ribs 2111 are used for enhancing the strength of a suspended portion of each side portion 211 located in front of the top plate 121. A seam portion 223 is further formed on the bottom wall 22 for allowing the shielding shell 2 to be fixed after bending deformation. A projection of one reinforcing rib 2111 on the bottom wall 22 is overlapped with the seam portion 223. A first abutting piece 2131 and a second abutting piece (not shown) are provided at corresponding positions of the middle portion 213 and the bottom wall 22 respectively to protrude forward for abutting on the insulating body 1, and the first abutting piece 2131 and the second abutting piece (not shown) are symmetrically arranged. A rear end of the first abutting piece 2131 is connected with the middle portion 213, a front end of the first abutting piece 2131 is separated from the middle portion 213, and the front end of the first abutting piece 2131 extends towards the interior of the shielding shell 2. Two protruding bars 224 are protrudingly provided upward on the bottom wall 22 of the shielding shell 2, and two recesses 1221 are correspondingly formed in the bottom plate 122 of the insulating body 1. The recesses 1221 run through a front end of the bottom plate 122 and accommodate the protruding bars 224. A portion of each protruding bar 224 protrudes out of the front end of the bottom plate 122 and supports a bottom portion of the mating connector 200.

Figure 6:
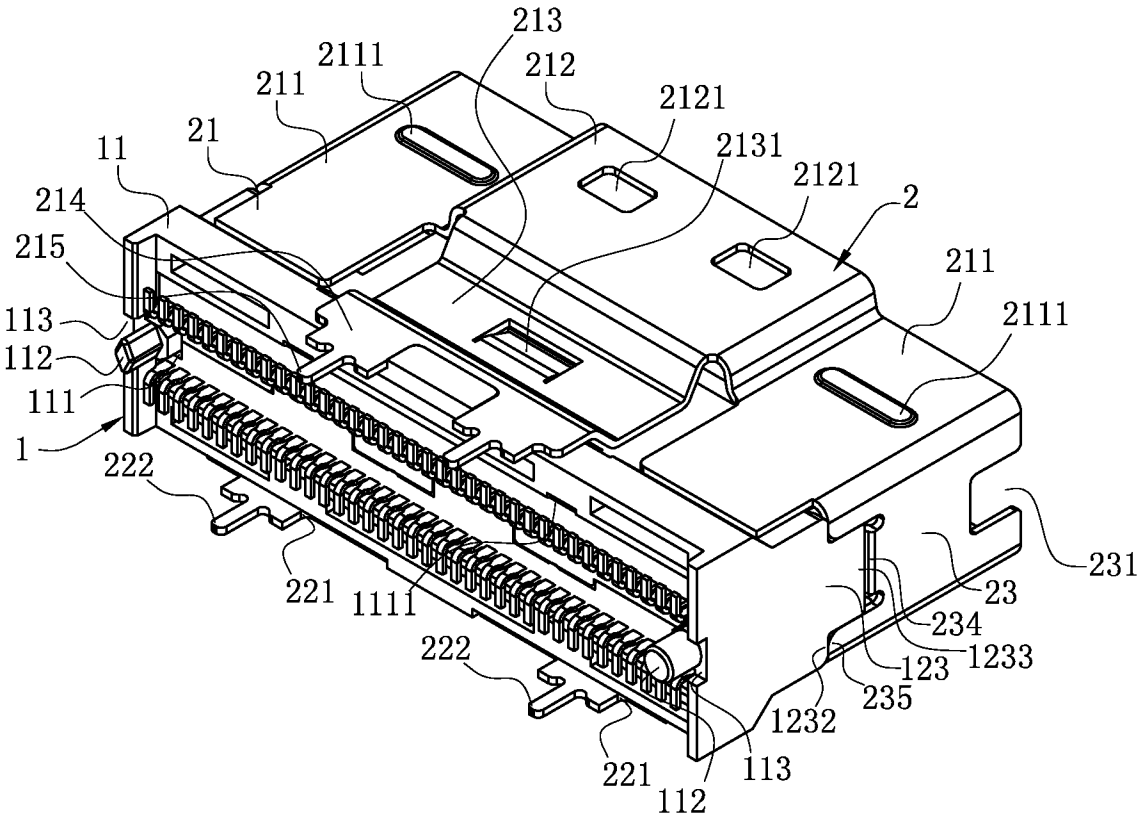
FIG. 6 is a schematic view of the electrical connector in FIG. 3 after being assembled and rotated by 180 degrees.

As shown in FIG. 3 and FIG. 6, each terminal module 3 includes terminals 31 in a row and an insulating block 32 insert-molded with the terminals 31. The frame portion 11 is provided with an accommodating cavity 111 to accommodate the terminal modules 3. The accommodating cavity 111 communicates with the mating cavity 124. An upper side and a lower side of the accommodating cavity 111 are respectively provided with two buckling grooves 1111, and each insulating block 32 is provided with two buckling blocks 321 buckling-matched with the buckling grooves 1111 at the upper side or the lower side of the accommodating chamber 111. Two mounting portions 112 are protrudingly provided backward on a bottom portion of the frame portion 11, and are installed in two mounting holes of the circuit board (not shown). The two mounting portions 112 are provided on an inner surface of the accommodating cavity 111 and have different shapes. One of the two mounting portions 112 is rhombic and the other is cylindrical. A concave portion 113 is provided at each side edge of the frame portion 11 and extends to a corresponding one of the mounting portions 112. The concave portions 113 are used for automatic mechanical orientation of the insulating body 1, and an edge of each mounting portion 112 is spaced from the corresponding side edge of the frame portion 11.

As shown in FIG. 3 and FIG. 5, during assembly of the electrical connector 100, the terminals 31 are insert-molded in the two insulating blocks 32 to form the two terminal modules 3. After the two terminal modules 3 are assembled together, the two terminal modules 3 are installed in the accommodating cavity 111 from a rear end of the frame portion 11. The two buckling blocks 321 of each insulating block 32 are buckled and matched in the two buckling grooves 1111 at the upper side or the lower side of the accommodating cavity 111 respectively. The terminals 31 are accommodated in the corresponding accommodating grooves 125, and the terminals 31 enter the mating cavity 124.

As shown in FIG. 1 and FIG. 2, the mating connector 200 includes a main body portion 4, an insertion portion 5 protruding out of the main body portion 4, and a latch member 6 mounted on the main body portion 4. The two opposite sides of the main body portion 4 are each provided with a positioning block 41. The positioning blocks 41 are used for matching with the openings 231 to fix the electrical connector 100 and the mating connector 200. The insertion portion 5 is provided with multiple golden fingers 51 for being conductively connected with the terminals 31. Two latching portions 61 are protrudingly provided on the latch member 6, and the latching portions 61 are used for latching with the buckling holes 2121 so as to fix the electrical connector 100 and the mating connector 200.

FIG. 10 to FIG. 13 show an electrical connector 100 according to a second embodiment of the present invention. The embodiment is different from the first embodiment in that: the protective members 232 are formed by punching inward from the side walls 23, and each edge of each of the protective members 232 is connected with the corresponding side wall 23. Each groove 1231 runs through the corresponding side plate 123 from inside to outside, so that a front end of the top plate 121 protrudes forward out of a front end of each side plate 123, and each side wall 23 is stopped backward to a front end of the corresponding barrier portion 1233.

FIG. 11 to FIG. 14 show an electrical connector 100 according to a third embodiment of the present invention. The embodiment is different from the first embodiment in that: the protective members 232 are made of a metal material, and are provided separately from the shielding shell 2. Each of the protective members 232 is protrudingly provided with multiple fastening portions 2321 to match with the corresponding grooves 1231, so as to fix the protective members 232 in the grooves 1231. A protruding block 1236 is protrudingly formed outward on an outer surface of each side plate 123, and each protruding block 1236 extends from one side of the corresponding groove 1231 so as to enhance the strength of the corresponding side plate 123. A protruding portion 236 is protrudingly formed outward on an outer surface of each side wall 23, and each protruding portion 236 covers the corresponding protruding block 1236 so as to protect the protruding block 1236. Each protective member 232 protrudes forwards out of a front end of the corresponding side plate 123, and bends toward a direction away from the mating cavity 124 to form the guide chamfer 234. A front end of each protruding portion 236 is located in front of the corresponding protective member 232 and shields a front end of the corresponding protective member 232, so as to prevent the insertion portion 5 from hitting the front ends of the protective members 232 during insertion and thus cannot be inserted into the mating cavity 124. An inner surface of each protective member 232 is provided with a rib 2322 extending in a vertical direction, and each of the ribs 2322 has an arc surface. The ribs 2322 protrudingly extends into the mating cavity 124, and the ribs 2322 have a limiting function and guide the insertion portion 5 to enter the mating cavity 124, thereby reducing scratching and damage of the insulating body 1 caused by incorrect alignment of the insertion portion 5.

In conclusion, the electrical connector according to certain embodiments of the present invention has the following beneficial advantages.

(1) Each groove 1231 is concavely formed backward at the front end of the corresponding side plate 123 of the insulating body 1 and communicates with the mating cavity 124, and the two protective members 232 are correspondingly accommodated in the grooves 1231, thus allowing the protective members 232 to shield the side plates 123. When the insertion portion 5 of the mating connector 200 is inserted into the mating cavity 124, the insertion portion 5 directly contacts with the protective members 232, thereby effectively reducing scratching and damage of the side plates 123 caused by incorrect alignment of the insertion portion 5 of the mating connector 200, and prolonging the service life of the electrical connector 100, so that the electrical connector 100 can better meet the requirements of users.

(2) A guide chamfer 234 is provided at a front end of each protective member 232, and the guide chamfer 234 is located in front of the corresponding side plate 123 and shields the corresponding side plate 123. The guide chamfer 234 provides a guiding function, so that the insertion portion 5 can be guided to enter the mating cavity 124 of the insulating body 1 by the guide chamfers 234, thereby reducing scratching and damage of the insulating body 1 caused by incorrect alignment of the insertion portion 5.

(3) The two limiting slots 1232 of each side plate 123 of the insulating body 1 stop the two limiting portions 235 of the corresponding side wall 23 of the shielding shell 2 respectively. By the limiting actions between the limiting portions 235 and the limiting slots 1232, the shielding shell 2 can be correctly positioned and mounted on the insulating body 1.

(4) The two protruding bars 224 are protrudingly provided upward on the bottom wall 22 of the shielding shell 2, and the two recesses 1221 are correspondingly formed in the bottom plate 122 of the insulating body 1. The recesses 1221 run through a front end of the bottom plate 122 and accommodate the protruding bars 224, thereby enhancing the retaining strength of the shielding shell 2 and the insulating body 1. A portion of each protruding bar 224 protrudes out of the front end of the bottom plate 122 and supports the bottom of the mating connector 200, so as to improve the mating stability of the electrical connector 100 and the mating connector 200.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments were chosen and described in order to explain the principles of the invention and their practical application so as to activate others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

What is claimed is:

1. An electrical connector configured to be electrically connected with a mating connector, comprising:

an insulating body, comprising a mating cavity enclosed by a top plate, a bottom plate and two side plates, the mating cavity allows an insertion portion of the mating connector to be inserted backward therein, wherein the top plate and the bottom plate are provided with a plurality of accommodating grooves, a front end of each of the two side plates is backward concavely provided with a groove, and the grooves communicate with the mating cavity;

a plurality of terminals, correspondingly accommodated in the accommodating grooves;

a shielding shell, fixed to the insulating body and provided with a top wall and two side walls located on two opposite sides of the top wall, wherein a mating port is enclosed by front ends of the top wall and the two side walls, the mating port is larger than the mating cavity, the top wall shields the top plate and extends forward beyond the top plate, and each of the side walls shields a corresponding one of the side plates and extends forward beyond the corresponding one of the side plates; and two protective members, respectively and correspondingly accommodated in the grooves, wherein a front end of each of the protective members is spaced from the front end of a corresponding one of the side walls in a front-rear direction.

2. The electrical connector according to claim 1, wherein an inner surface of each of the side walls protrudes inward to form a corresponding one of the protective members.

3. The electrical connector according to claim 2, wherein each of the side walls is concavely provided with two notches respectively at a top end and a bottom end of the corresponding one of the protective members, the notches extend through toward rear ends of the side walls, and each of the protective members is located between the mating cavity and the corresponding one of the side plates.

4. The electrical connector according to claim 2, wherein two limiting portions are provided at a rear end of each of the side walls and located above and below the corresponding one of the protective members respectively, and the insulating body is provided with two limiting slots to stop the two limiting portions respectively.

5. The electrical connector according to claim 4, wherein each of the side plates is provided with a barrier portion between the two limiting slots, and each of the side walls is stopped backward at a front end of the corresponding barrier portion.

6. The electrical connector according to claim 4, wherein each of the side plates is provided with a barrier portion between the two limiting slots, and each of the protective members is located between the mating cavity and the corresponding barrier portion.

7. The electrical connector according to claim 2, wherein each of the side walls is punched inwards to form the corresponding one of the protective members, and each edge of the protective members is connected with the side walls.

8. The electrical connector according to claim 1, wherein a top end of each of the protective members is higher than the mating cavity, and a bottom end of each of the protective members is lower than the mating cavity.

9. The electrical connector according to claim 1, wherein a guide chamfer is provided at a front end of each of the protective members, and the guide chamfer is located in front of a corresponding one of the side plates and shields a front end of the corresponding one of the side plates.

10. The electrical connector according to claim 1, wherein the insulating body is protrudingly provided with two mounting portions installed in two mounting holes of a circuit board, one of the mounting portions is rhombic and the other mounting portion is cylindrical, a concave portion is formed at each of side edges of the insulating body and extends to a corresponding one of the mounting portions, and an edge of each of the mounting portions is spaced from a corresponding one of the side edges of the insulating body.

11. The electrical connector according to claim 1, wherein the shielding shell is further provided with a bottom wall connected with the two side walls, two protruding bars are protrudingly provided upward on the bottom wall, two recesses are correspondingly formed on the bottom plate, and the recesses run through a front end of the bottom plate and accommodate the protruding bars.

12. The electrical connector according to claim 11, wherein the top wall is further provided with two side portions and a protrusion portion located between the two side portions, the protrusion portion is provided with at least one buckling hole configured for latching the mating connector, and a projection of the protrusion portion on the bottom wall is located between the two protruding bars.

13. The electrical connector according to claim 11, wherein a portion of each of the protruding bars protrudes forward out of the front end of the bottom plate.

14. The electrical connector according to claim 1, wherein each of the side plates is provided with a first surface and a second surface formed by extending backward from the first surface, each of the protective members is stopped backward to the corresponding first surface, and each of the protective members is parallel to the second surface and do not extend laterally and inwardly beyond the second surface.

15. The electrical connector according to claim 1, wherein each of the grooves runs through the corresponding side plate from inside to outside, such that a front end of the top plate protrudes forward out of the front end of each of the side plates.

16. The electrical connector according to claim 1, wherein a protruding block is protrudingly formed outward on an outer surface of each of the side plates, and the protruding block extends from one side of the corresponding groove.

17. The electrical connector according to claim 16, wherein a protruding portion is protrudingly formed outward on an outer surface of each of the side walls, and the protruding portion covers the corresponding protruding block.

18. The electrical connector according to claim 17, wherein the protective members and the shielding shell are arranged separately, each of the protective members protrudes forward out of a front end of the corresponding one of the side plates, and a front end of the protruding portion is located in front of a corresponding one of the protective members and shields a front end of the corresponding one of the protective members.

19. The electrical connector according to claim 1, wherein the protective members and the shielding shell are arranged separately, and each of the protective members is protrudingly provided with a plurality of fastening portions to match with the grooves, so as to fix the protective members in the corresponding grooves.

20. The electrical connector according to claim 1, wherein an inner surface of each of the protective members is provided with a rib extending in a vertical direction, and the rib protrudingly extends into the mating cavity.

* * * * *